US008371135B2

(12) United States Patent
Lee

(10) Patent No.: US 8,371,135 B2
(45) Date of Patent: Feb. 12, 2013

(54) REFRIGERATOR AND CONTROL METHOD THEREOF

(75) Inventor: Sung-Ae Lee, Changwon (KR)

(73) Assignee: LG Electronics Inc., Seoul (KR)

( * ) Notice: Subject to any disclaimer, the term of this patent is extended or adjusted under 35 U.S.C. 154(b) by 418 days.

(21) Appl. No.: 12/674,612

(22) PCT Filed: Aug. 22, 2008

(86) PCT No.: PCT/KR2008/004930

§ 371 (c)(1),
(2), (4) Date: Feb. 22, 2010

(87) PCT Pub. No.: WO2009/025531

PCT Pub. Date: Feb. 26, 2009

(65) Prior Publication Data

US 2011/0126555 A1 Jun. 2, 2011

(30) Foreign Application Priority Data

Aug. 23, 2007 (KR) ..... 10-2007-0084690

(51) Int. Cl.
*F25B 49/00* (2006.01)

(52) U.S. Cl. ..... 62/127; 62/129; 62/331

(58) Field of Classification Search ..... 62/129, 62/127, 56, 389, 441, 331; 713/300, 320; 340/310.06, 310.01; 235/462.46, 375
See application file for complete search history.

(56) References Cited

U.S. PATENT DOCUMENTS

| | | | | |
|---|---|---|---|---|
| 2002/0079371 | A1* | 6/2002 | Bobrow et al. | 235/454 |
| 2005/0258961 | A1* | 11/2005 | Kimball et al. | 340/572.1 |
| 2006/0129855 | A1* | 6/2006 | Rhoten et al. | 713/320 |
| 2007/0152048 | A1* | 7/2007 | Jung et al. | 235/385 |

FOREIGN PATENT DOCUMENTS

| | | | |
|---|---|---|---|
| KR | 10-2002-0047618 | A | 6/2002 |
| KR | 10-2005-0110147 | A | 11/2005 |
| KR | 10-2006-0119580 | A | 11/2006 |

* cited by examiner

*Primary Examiner* — Mohammad Ali
(74) *Attorney, Agent, or Firm* — Birch, Stewart, Kolasch & Birch, LLP

(57) ABSTRACT

Provided are a refrigerator and a controlling method thereof. The refrigerator includes a main body, a display device, a radio frequency identification (RFID) reader, an audio output, an audio input, a voice recognizer, and a display controller. The display device is on the main body and includes a display. The RFID reader is on the display device or the main body. The audio output outputs through audio to an outside whether to enter a food name, when an RFID tag attached to a food item or a container holding the food item is read by the RFID reader. The audio input is on the display device, to which audio from the outside can be input. The voice recognizer reads audio input to the audio input. The display controller controls the display device to display on the display a screen corresponding to data read by the voice recognizer. Thus, a food name can be entered by a user's selection or through reading an RFID tag, and a food name can be entered through audio or through a screen on a display, so that a user's range of options is broadened, and convenience is increased.

9 Claims, 6 Drawing Sheets

| ◀BY STORED ORDER▶ | BY TYPE | BY EXPIRATION DATE | BY NAME |
|---|---|---|---|
| FOOD NAME | DATA STORED | FOOD TYPE | EXPIRATION DATE |
| STRAWBERRIES | JULY 1, 2007 | FRULT | 3 DAY LEFT O |
| CARROTS | JULY 1, 2007 | VEGETABLES | 1 WEEK LEFT O |
| CELERY | JULY 2, 2007 | VEGETABLES | 3 DAY LEFT O |
| POTATOES | JULY 3, 2007 | VEGETABLES | 1 DAY LEFT O |

REFRIGERATOR AND CONTROL METHOD THEREOF

TECHNICAL FIELD

The present embodiments relate to a refrigerator and a controlling method thereof.

BACKGROUND ART

In general, a refrigerator is an apparatus for storing food at low temperatures. A user can buy desired food items and store them in a refrigerator. The user can then remove and use the stored foods at will.

Also, a user can check what foods are inside a refrigerator, and purchase foods that are needed or in short supply. Furthermore, a user examines each food item stored in a refrigerator to check its expiration date.

Specifically, in refrigerators according to the related art, food items stored in refrigerators cannot accurately be determined, requiring users to examine each item individually. Thus, having to check the expiration dates of food and individual food items is cumbersome.

DISCLOSURE OF INVENTION

Technical Problem

Embodiments provide a refrigerator and a controlling method thereof that allow collective management of foods stored within the refrigerator.

Embodiments also provide a refrigerator and a controlling method thereof that enable a user to easily manage foods.

Technical Solution

In one embodiment, a refrigerator includes: a main body; a display device on the main body, and including a display; a radio frequency identification (RFID) reader on the display device or the main body; an audio output outputting through audio to an outside whether to enter a food name, when an RFID tag attached to a food item or a container holding the food item is read by the RFID reader; an audio input on the display device, to which audio from the outside can be input; a voice recognizer reading audio input to the audio input; and a display controller controlling the display device to display on the display a screen corresponding to data read by the voice recognizer, wherein the refrigerator allows entering a food name through the audio input or through the screen displayed on the display, through displaying a food name entry screen on the display, when an input is selected for a food name entry output through audio, with the food name entry screen displayed.

In another embodiment, a refrigerator includes: a main body; a display device on the main body, and including a display; an input on the display device to manipulate for entering information on a food item that is stored; a radio frequency identification (RFID) reader on the display device or the main body, for reading an RFID tag attached to the stored food item or a container holding the stored food item; an audio input on the display device, to which audio from an outside can be input; a voice recognizer reading the audio input to the audio input; and a display controller controlling the display device to display on the display a screen corresponding to data read by the voice recognizer, to data read by the RFID reader, or to data input to the input.

In a further embodiment, a method for controlling a refrigerator, includes: inputting a signal for entering food information; displaying on a display a screen for entering food information; determining whether food information has been entered when the screen is displayed; and displaying a screen for checking entered food information when the food information has been entered.

In a still further embodiment, a method for controlling a refrigerator, includes: reading a radio frequency identification (RFID) tag attached to a food item or to a container holding the food item; outputting an audio signal inquiring whether to enter food information; displaying on a display a screen for entering food information; determining whether food information has been entered when the screen is displayed; and displaying a screen for checking entered food information when the food information has been entered.

Advantageous Effects

According to the provided embodiments, the names of food items can be input through a user's selections or reading of radio frequency identification (RFID) tags, and names of food items can be input through audio or entered into a display device, so that a user's range of options is expanded to increase convenience.

Also, because names of foods that are stored in a refrigerator can be saved, after which foods stored thereafter can be checked, management of stored food items is made easier. Additionally, because a user can enter the expiration dates of stored foods, storing of foods for prolonged periods or foods going bad can be prevented.

Furthermore, because a display device can be separated from a refrigerator, management of stored foods can be performed with the display device separated.

BEST MODE FOR CARRYING OUT THE INVENTION

Reference will now be made in detail to the embodiments of the present disclosure, examples of which are illustrated in the accompanying drawings.

Figure 1:
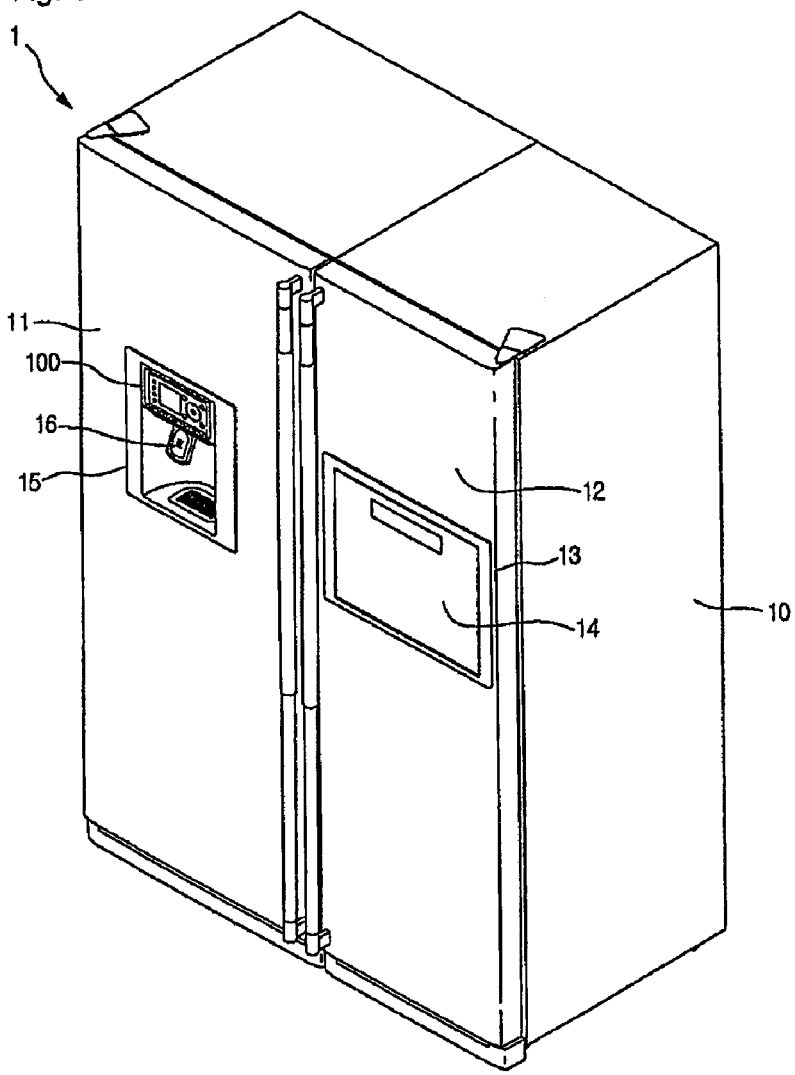
FIG. 1 is a perspective view of a refrigerator provided with a display device according to a first embodiment of the present disclosure.
Figure 2:
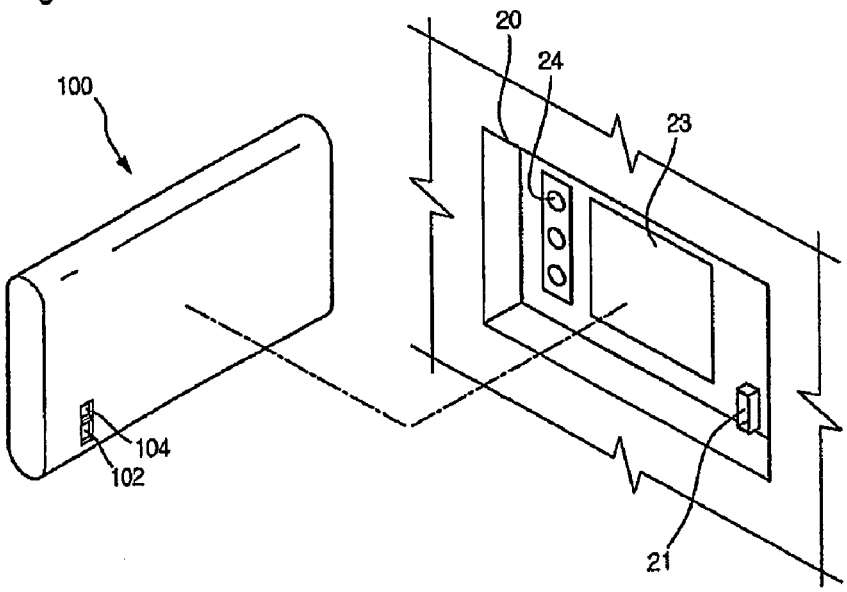
FIG. 2 is a perspective view showing the display device separated from the refrigerator.

FIG. 1 is a perspective view of a refrigerator provided with a display device according to a first embodiment of the present disclosure, and FIG. 2 is a perspective view showing the display device separated from the refrigerator.

Referring to FIGS. 1 and 2, a refrigerator 1 according to present embodiments includes a main body 10 defining a freezer compartment and a refrigeration compartment within, and a freezer compartment door 11 and a refrigeration compartment door 12 that open and close the freezer compartment and refrigeration compartment, respectively.

In detail, the freezer compartment and the refrigeration compartment are partitioned to the left and right of one another in the present embodiment. However, it will be noted that there are no restrictions on the positions of the freezer compartment and the refrigeration compartment according to the spirit and scope of the present embodiments.

A home bar 13 is provided in the freezer compartment door 12 to allow food to be removed without opening the freezer compartment door 12, and the home bar 13 includes a home bar door 14.

A dispenser 15 is formed on the freezer compartment door 11 to enable water or ice to be dispensed from outside the refrigerator 1, and the dispenser 15 includes a dispensing lever 16. Here, while not shown, a water container may be provided on the freezer compartment door 11 to hold an icemaker that generates ice and water.

A display device 100 is provided above the dispenser 15 to display the operating state of the refrigerator. The display device 100 may be detachable from the freezer compartment door 11. Of course, the display device 100 may be attachable/detachable to and from the refrigeration compartment door 12.

In detail, a coupling portion 20 to which the display device 100 is coupled is formed on the freezer compartment door 11. The coupling portion 20 is formed recessed rearward from the front surface of the freezer compartment door 11.

Also, a first connecting portion 21 is formed on the coupling portion 20 to connect to the display device 100, and a second connecting portion 102 is formed on the display device 100 to connect to the first connecting portion 21.

A sealing cover 104 for sealing the second connecting portion 102 is formed on the display device 100. The sealing cover 104 is provided to be capable of sliding on the display device 100.

Accordingly, with the display device 100 separated from the freezer compartment door 11, the sealing cover 104 closes the second connecting portion 102 to prevent entry of impurities into the second connecting portion 102.

Also, with the first connecting portion 21 and the second connecting portion 102 connected, the display device 100 can be supplied with power from the refrigerator 1. That is, with the display device 100 coupled to the refrigerator 1, a battery (not shown) provided in the display device 100 can be charged.

In addition, with the first connecting portion 21 and the second connecting portion 102 connected, the display device 100 and the refrigerator 1 can transmit/receive data to and from one another. Specifically, with the display device 100 coupled to the refrigerator 1, operating commands for the refrigerator 1 can be input through the display device 100.

Furthermore, information on food stored in the refrigerator 1 can be transmitted to the display device 100. Here, the information on food stored in the refrigerator 1 is data that is read through an RFID reader described below.

The coupling portion 20 is provided with an auxiliary input 24 for inputting operating commands for the refrigerator 1 with the display device 100 separated, and an auxiliary display 23 for displaying the operating state of the refrigerator 1.

In detail, the auxiliary display 23 is automatically switched off when the display device 100 is coupled to the refrigerator 1, and is automatically switched on when the display device 100 is separated from the refrigerator 1.

Here, in order to protect the auxiliary display 23, when the display device 100 is coupled to the coupling portion 20, the rear surface of the display device 100 may be separated from the auxiliary display 23.

In the present embodiment, the auxiliary display 23 and the auxiliary input 24 have been described as formed on the coupling portion 20; alternatively, a cover may be separately provided to be capable of sliding to selectively seal the coupling portion 20, and the auxiliary display 23 and the auxiliary input 24 may be formed on the cover. In this case, with the display device 100 separated, the cover seals the coupling portion 20 to prevent the coupling portion 20 from being exposed.

Figure 3:
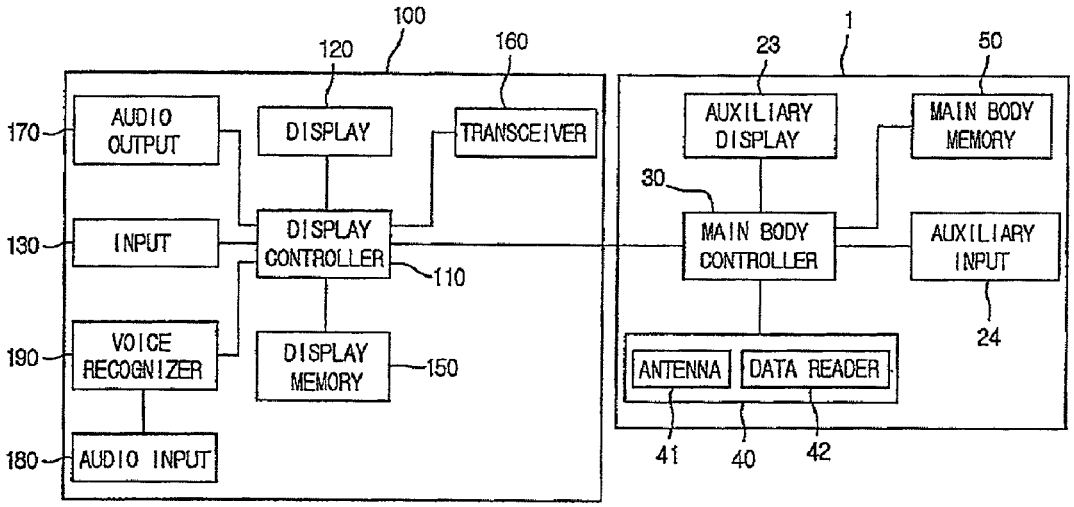
FIG. 3 is a block diagram showing the configuration of a refrigerator according to the first embodiment.

FIG. 3 is a block diagram showing the configuration of a refrigerator according to the first embodiment.

Referring to FIG. 3, a refrigerator 1 according to the present embodiment includes a main body controller 30 that controls the overall operation of the refrigerator 1, an auxiliary input 24 for inputting operating commands for the refrigerator 1 with the display device 100 separated, an auxiliary display 23 for displaying the operating state of the refrigerator 1 with the display device 100 separated, an RFID reader 40 for reading inherent data of food stored in RFID tags attached to the food or to compartments in which the food is stored, and a main body memory 50 for storing data read by the RFID reader 40, etc.

The display device 100 includes a display controller 110 for controlling the operation of the display device 100, an input 130 for a user to input operating commands with, a display 120 that displays the operating state of the display device 100, an audio output 170 for aurally outputting various data, an audio input 180 for aurally inputting commands from the outside, a voice recognizer 190 for recognizing audio inputs, a display memory 150 for storing various data, and a transceiver 160 for communicating.

In detail, the RFID reader 40 may be provided inside or outside the refrigerator 1, and may be disposed in the main body 10 or the doors 11 and 12.

Also, the RFID reader 40 may include an antenna 41 for exchanging radio frequencies with RFID tags, and a data reader 42 for processing data received through the antenna 41. Also, the information on foods read by the data reader 42 is transmitted to the main body controller 30 and stored in the main body memory 50.

Further, when the display device 100 is coupled to the refrigerator 1, data stored in the main body memory 50 is transferred to the display device 100 and stored in the display memory 150. Accordingly, a user can check various data on foods stored in the refrigerator 1 through the display device 100, and can also check various data on foods stored in the refrigerator 1 with the display device 100 separated from the refrigerator 1.

Also, the display memory 150 may have various data on foods pre-stored. For example, it may have information on how to select fresh vegetables and how to store vegetables.

Accordingly, with the display device 100 carried by a user, the user can shop while checking such information. Thus, a user can purchase better quality produce.

The input 130 can be used not only to input operating conditions of the display device 100, but also operating conditions for the refrigerator 1 when the display device 100 is coupled to the refrigerator 1.

That is, when a user inputs operating conditions for the refrigerator 1 through the input 130, the display controller 110 transmits a signal to the main body controller 30. Then, the main body controller 30 operates the refrigerator 1 in accordance with the input conditions.

The transceiver 160 enables digital multimedia broadcasting (DMB) from the display device 100. Accordingly, the display device 100 can be described as having the function of a DMB terminal.

Figure 4:
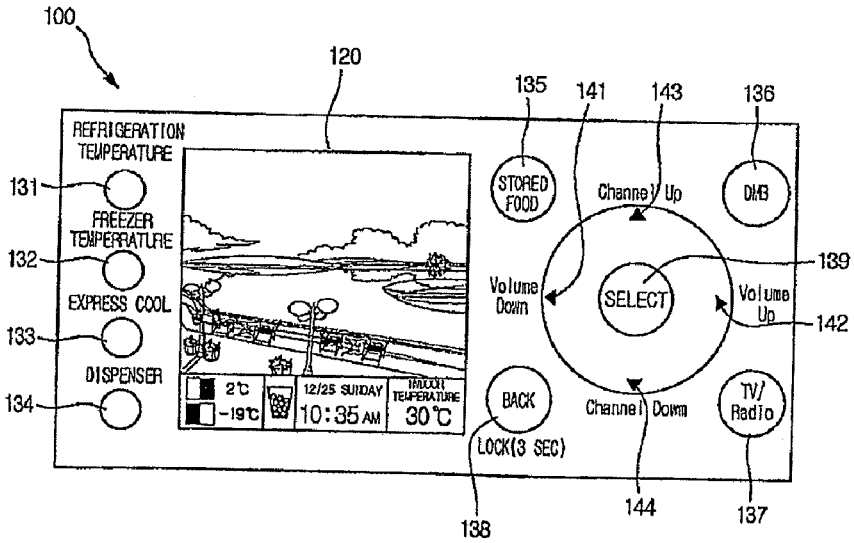
FIG. 4 is a frontal view of the display device according to the first embodiment.

FIG. 4 is a frontal view of the display device according to the first embodiment.

Referring to FIG. 4, a display 120 is disposed on the front surface of the display device 100. Also, the input 130 is configured around the display 120.

In detail, with the display device 100 mounted to the refrigerator 1, the operating state of the refrigerator 1 may be displayed on the display 120. Also, when the display device 100 is separated from the refrigerator 1, the state of the display device may be displayed on the display.

That is, when the display device 100 is mounted to the refrigerator 1, the display controller 110 detects the mounted state, and the display 120 displays a main screen showing the operating state of the refrigerator 1.

Conversely, when the display device 100 is separated from the refrigerator 1, the display controller 110 detects the separated state, and the display 120 displays a main screen showing the operating state of the display device 100.

The input 130 includes a refrigeration temperature button 131 for selecting the temperature for the refrigeration compartment, a freezer temperature button 132 for selecting the temperature for the freezer compartment, an express cool button 133 for selecting a quick cooling function, and a dispenser button 134 for selecting operation of the dispenser 15. Specifically, the buttons 131 to 134 are for selecting operations for the refrigerator.

The input 130 also includes a stored food button 135 for checking and inputting various data on food through the display device 100, a DMB button 136 for selecting a DMB function, a TV/Radio button 137 for selecting a TV or Radio function, a back button 138 for returning to the previous screen from the currently displayed screen on the display 120, and a select button 139 for selecting various functions.

Additionally, when one of the above buttons is selected to display a corresponding menu, the input 130 includes cursor buttons for selecting a function from the displayed menu. The cursor buttons include a left button 141, a right button 142, an up button 143, and a down button 144.

Here, when the DMB button 136 and the TV/Radio button 137 are selected, the cursor buttons can be used to adjust volume and select channels.

Figure 5:
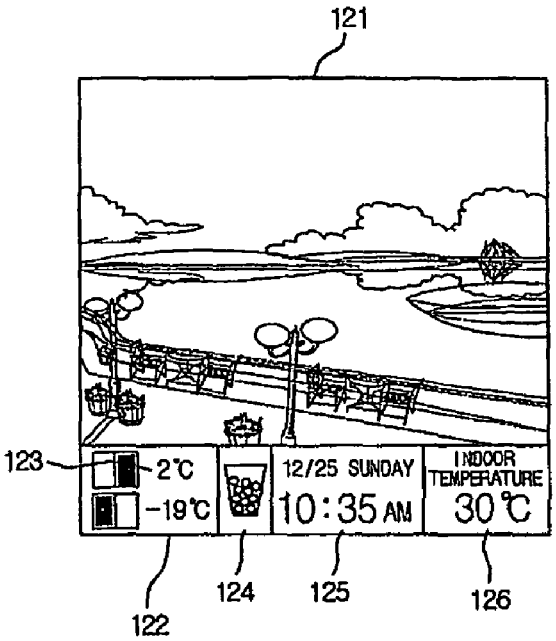
FIG. 5 is a diagram showing an example of a refrigerator main screen displayed on a display device.

FIG. 5 is a diagram showing an example of a refrigerator main screen displayed on a display device.

Referring to FIG. 5, when a background image is displayed on a main screen 121, the background image can be changed. Also, at the bottom of the background image, an information window 122 displays operating conditions of the refrigerator.

Furthermore, the information window 122 includes a compartment temperature window 123 displaying the temperatures of the freezer compartment and the refrigeration compartment, an ice window 124 for displaying the state of dispensed ice, a clock window 125 for displaying the current date and time, and an indoor temperature window 126 for displaying the current indoor temperature.

Figure 6:
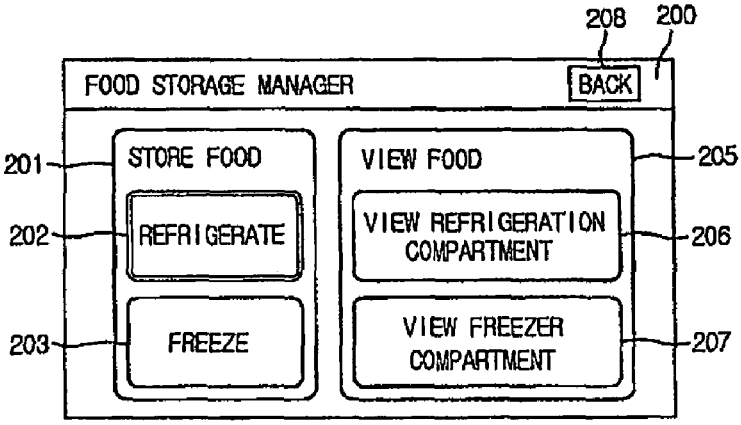
FIG. 6 is a diagram showing an example of a food storage manager screen displayed on the display device.

FIG. 6 is a diagram showing an example of a food storage manager screen displayed on the display device.

Referring to FIG. 6, when a user selects the stored food button 135, the display 120 displays a food storage manager button 200.

In detail, a user selects the stored food button 135 to manage storage or removal of food and check stored foods. In particular, when food does not have RFID tags attached, the stored food button 135 is selected to manage the storing and removing of food.

Because automatic reading of data on food cannot be performed when the food does not have RFID tags attached, a user must directly select the stored food button 135 and input data such as the storage, removal, and expiration dates of the food.

Also, the food storage manager screen 200 displays a select compartment window 201 for selecting where to store new food, a view food window 205 to check foods stored in the refrigerator 1, and a back button 208 to return to the previous screen. Here, when the back button 208 is selected, the display returns to the refrigerator main screen 121.

The select compartment window 201 displays a refrigerate button 202 and a freeze button 203 for selecting the refrigeration or freezer compartment. Also, the view food window 205 displays a view refrigeration compartment button 206 and a view freezer compartment button 207.

Further, a user can select each button 202, 203, 206, and 207 through touch-screen operation. Of course, a user can use the cursor buttons 141 to 144 and the select button 139 to select each button 202, 203, 206, and 207.

Figure 7:
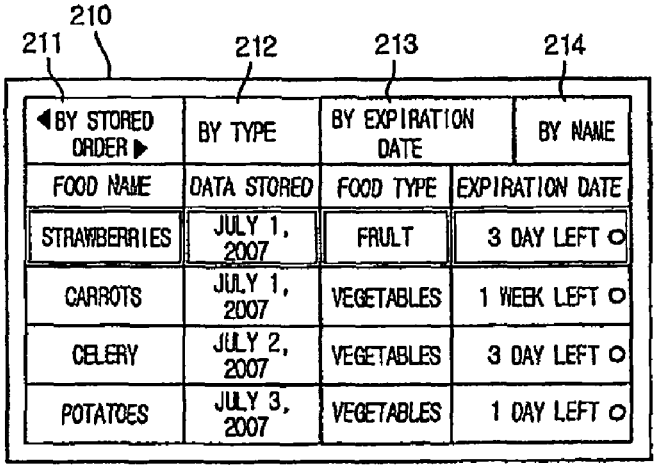
FIG. 7 is a diagram showing an example of a list stored food screen that is displayed when the view refrigeration compartment button is pressed on the food storage manager screen in FIG. 6.

FIG. 7 is a diagram showing an example of a list stored food screen that is displayed when a view refrigeration compartment button is pressed on the food storage manager screen in FIG. 6.

Referring to FIG. 7, in order to check the list of foods stored in refrigeration compartment, for example, on the food storage manager screen 200, when the refrigerate button 206 is selected, a list stored food screen 210 is displayed on the display 120.

Then, the list stored food screen 210 displays the names, types of food, stored dates, and expiration dates of stored foods. Also, the list stored food screen 210 displays selection buttons for changing the listed order of food categories.

In detail, the selection buttons include a by stored order button 211 for displaying the food list by date stored, a by type button 212 for displaying the food list by food type, a by expiration date button 213 for displaying the food list by order of expiration date, and a by name button 214 for displaying the food list by food name.

Also, a user can select the respective buttons 211, 212, 213, 214 depending on requirements, and check various information on food stored in the refrigeration compartment.

Figure 8:
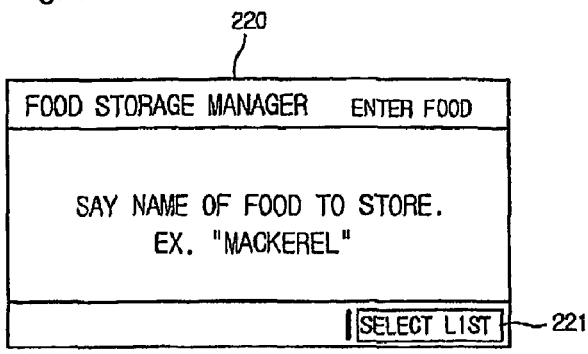
FIG. 8 is a diagram showing an example of an enter food name screen that is displayed when the refrigerate button is selected on the food storage manager screen in FIG. 6.

FIG. 8 is a diagram showing an example of an enter food name screen that is displayed when the refrigerate button is selected on the food storage manager screen in FIG. 6.

Referring to FIG. 8, when the refrigerate button 202 is selected in the food storage manager screen 200 in FIG. 6, the display 120 displays an enter food name screen 220.

Also, when the display 120 displays the enter food name screen 220, the audio output 170 outputs enter food by audio.

In detail, the enter food name screen 220 displays the output audio message. For example, the message, "Say name of food to store. Ex. 'Mackerel'" is displayed.

Also, a select list button 221 is displayed below the enter food name screen 220 to display a list from which a user can directly select a food to be stored.

Accordingly, a user can speak and aurally enter the name of a food to be stored, or directly enter the food selected through the select list button 221.

In such cases, a user can simultaneously check with both eyes and ears signals for food entry and enter food names through audio or by selecting them on-screen, so that user convenience is improved.

Here, the enter food name screen 220 may be displayed when the user wishes to enter a food name when the RFID reader reads an RFID tag attached to the food. This will be described below.

Figure 9:
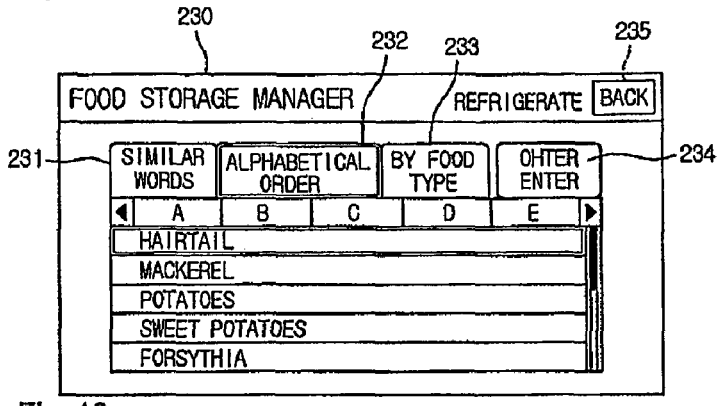
FIG. 9 is a diagram showing an example of a list stored food screen that is displayed when the select list button is selected in the enter food name screen in FIG. 8.

FIG. 9 is a diagram showing an example of a list stored food screen that is displayed when the select list button is selected in the enter food name screen in FIG. 8.

Referring to FIG. 9, when the select list button 221 is selected in the enter food name screen 220 in FIG. 8 to directly enter a food name, the display 120 displays a food list screen 230.

In detail, the food name displayed in the food list screen 230 is stored in the display memory 110.

Also, selection buttons for changing the listed order of food names is displayed on the food list screen 230. The selection buttons include a similar words button 231 for displaying a food list in terms of similar words, an alphabetical order button 232 for displaying the food list in alphabetical order by name, and a by food type button 233 for displaying the food list by food type.

The food list screen 230 also includes an other entry button 234 for entering food names not stored in the display memory, and a back button 235 for restoring the previous screen.

Therefore, a user can use the respective buttons 231, 232, and 233 to check the food list and select a food name corresponding to the food item to be stored.

Figure 10:
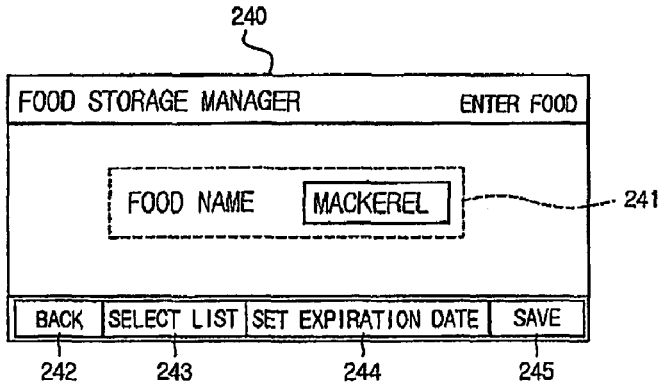
FIG. 10 is a diagram showing an example of an enter food name screen that is displayed when entering a food name.

FIG. 10 is a diagram showing an example of an enter food name screen that is displayed when entering a food name.

Referring to FIG. 10, when food names are input through audio or through the food list, the display 120 displays a verify food entry screen 240.

In detail, the verify food entry screen 240 displays a display window 241 showing the food name selected. Also, included below the display window 241 are a back button 242 for restoring the previous screen, a select list button 243 for re-entering the food name through checking the food list, a set expiration date button 244 for selecting the expiration date of food, and a save button 245 for saving the selected food name.

In more detail, if a user utters a food name in error, the user can select the back button 242. When the back button 242 is selected, the enter food name screen 220 is displayed. Then, the user can re-enter the food name through audio or by selecting from the screen.

Also, when a user erroneously selects a food name, the user can select the select list button 243. When the select list button 243 is selected, the food list screen 230 is displayed. Then, the user can re-select and enter the food name in the food list screen 230.

Then, when the user wishes to enter the expiration date of the food, the user can select the set expiration date button 244.

If determining that the entered food name is accurate and not wishing to set an expiration date for the food, the user can select the save button 245.

Figure 11:
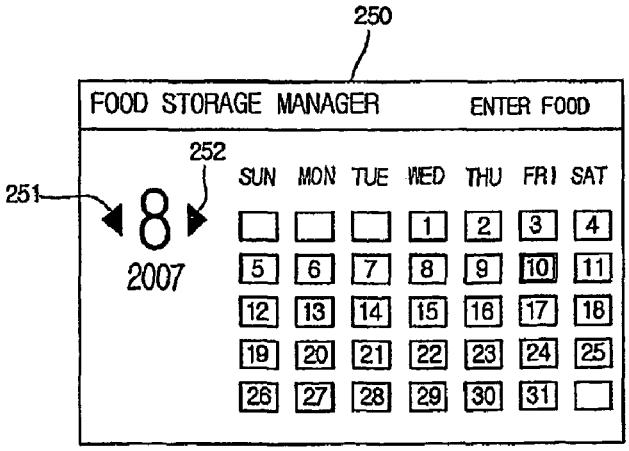
FIG. 11 is a diagram showing an example of a select expiration date screen that is displayed when setting expiration dates in the enter food name screen in FIG. 10.

FIG. 11 is a diagram showing an example of a select expiration date screen that is displayed when setting expiration dates in the enter food name screen in FIG. 10.

Referring to FIG. 11, when the set expiration date button 244 is selected to enter the expiration date for food stored, the display 120 displays a select expiration date screen 250.

In detail, the select expiration date screen 250 displays the current month and a calendar of the current month. Selection buttons 251 and 252 are displayed on the select expiration date screen 250 for a user to select a month. Then, the user selects the expiration date of the food to be stored.

Thus, when the user enters the expiration date, when an expiration date approaches, the display 120 displays a screen that alerts the user of this.

Figure 12:
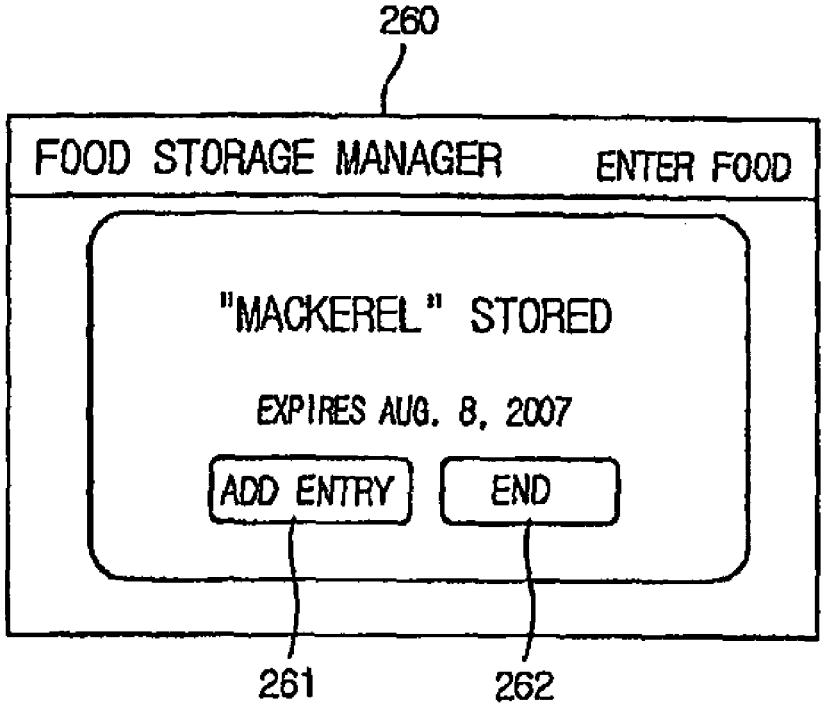
FIG. 12 is a diagram showing an example of a stored food notification screen that is displayed when a food name is stored.

FIG. 12 is a diagram showing an example of a stored food name notification screen that is displayed when a food name is stored.

Referring to FIG. 12, when an expiration date is selected in the select expiration date screen in FIG. 10, the display 120 displays a stored food notification screen 260.

In detail, the stored food notification screen 260 displays the name and expiration date of stored food. Here, when the expiration date is selected in the select expiration date screen 250, the expiration date information is displayed on the stored food notification screen 260, and when the save button 244 is selected in the verify food entry screen 240 in FIG. 10, the expiration date information is not displayed on the stored food notification screen 260, but only the name of the stored food is displayed.

Also, an add entry button 261 for entering additional information, and an end button 262 for ending the entering of food names are displayed on the stored food notification screen 260.

When a user selects the add entry button 261, the enter food name screen 220 is displayed. Also, when a user selects the end button 262, the refrigerator main screen 121 is displayed.

Figure 13:
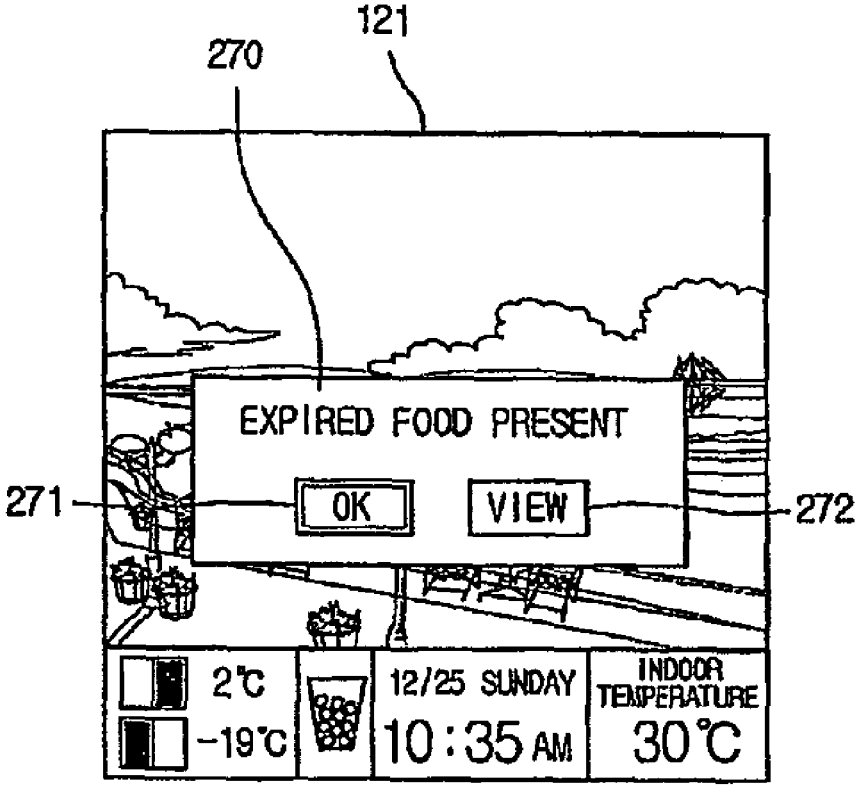
FIG. 13 is a diagram showing an example of a main screen that is displayed when the end button is selected in the stored food notification screen in FIG. 12.

FIG. 13 is a diagram showing an example of a main screen that is displayed when the end button is selected in the stored food notification screen in FIG. 12.

Referring to FIG. 13, when the end button 262 is selected in the stored food notification screen after entering of food has been completed, the display 120 displays the refrigerator main screen 121.

Here, the refrigerator main screen 121 displayed on the display 120 is the same as that in FIG. 5, except for the addition of an expiration date alert window 270.

In detail, the expiration date alert window 270 is displayed when food whose expiration date has been reached is present. Thus, when there is no food whose expiration date has been reached, the expiration date alert window 270 is not displayed.

The expiration date alert window 270 includes an OK button 271 and a view button 272. When the OK button 271 is selected, the expiration date alert window 270 is removed. Conversely, when the view button 272 is selected, the list stored food screen 210 is displayed. Here, food is listed in order from that closest to the expiration date in the list stored food screen 210.

Below, a description will be provided of a process of entering information on food for managing food.

Figure 14:
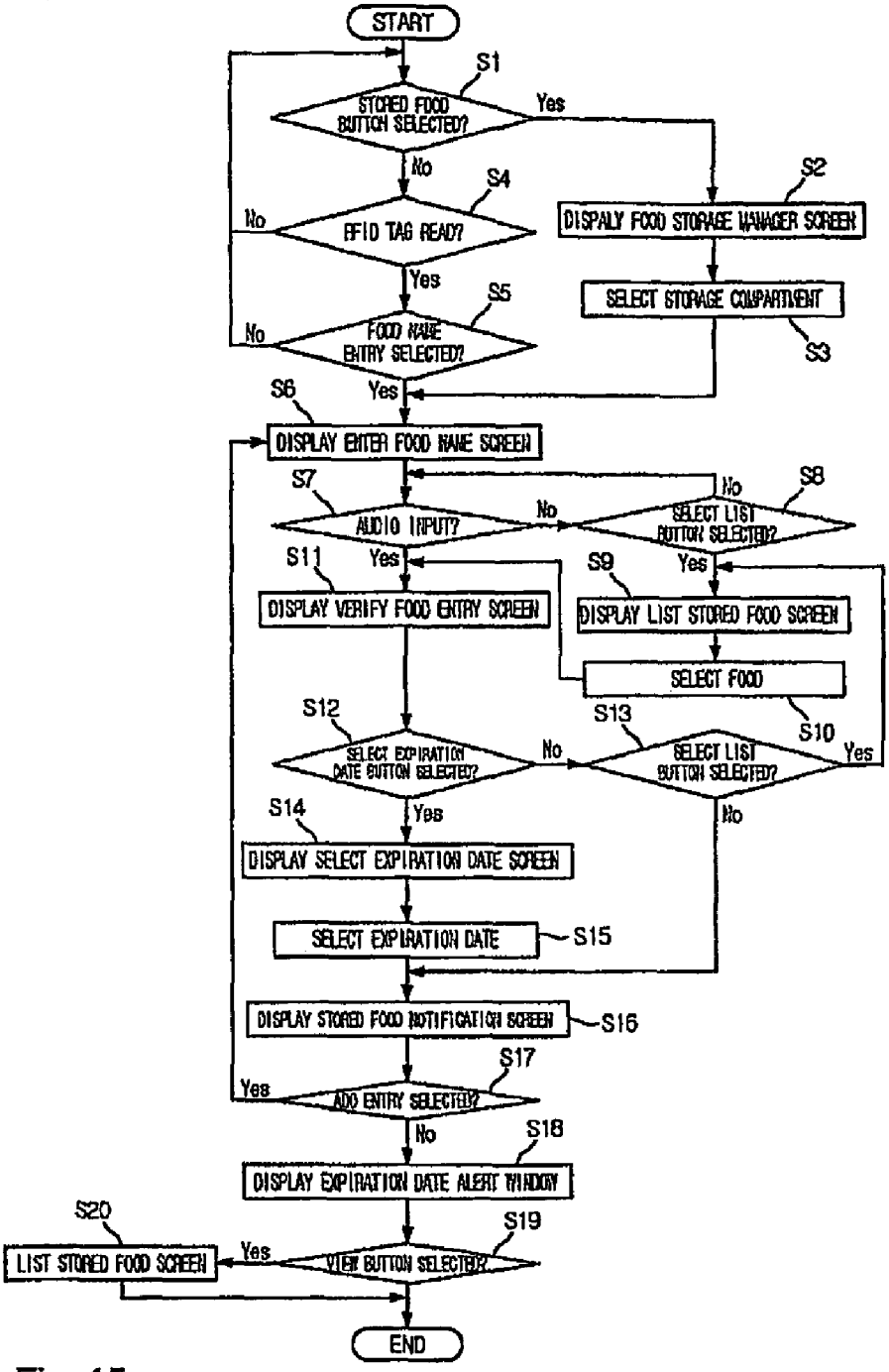
FIG. 14 is a diagram for describing a controlling method of a refrigerator according to present embodiments.

FIG. 14 is a diagram for describing a controlling method of a refrigerator according to present embodiments.

Referring to FIG. 14, it is determined in operation S1 by the display controller 110 whether the stored food button 135 has been selected.

When it is determined that the stored food button 135 has been selected, the display 120 displays the food storage manager screen 200 in operation S2. Next, a storage compartment for storing food is selected in operation S3. Then, when the storage compartment for storing food is selected, the enter food name screen 220 is displayed in operation S6.

Conversely, in operation S1, if it is determined that the stored food button 135 has not been selected, it is determined in operation S4 whether an RFID tag attached to the food or to a container holding the food has been read by the RFID reader 40.

If the results of the determining in operation S4 find that the RFID tag has not been read, operation S1 is revisited. On the other hand, if the determining in operation S4 find that the RFID tag has been read, it is then determined in operation S5 whether a food name input command has been received.

Here, after it is determined in operation S4 that the RFID tag has not been read, a message asking whether to output a food name is to be entered is output from the audio output 170. For example, the audio output may output the message, "Meat has been stored. Would you like to enter a food name?"

The RFID tag records inherent information on the food, and may include an accurate food name and may include a food type. When the information recorded on the RFID tag includes food type, there is a need to enter the accurate food name.

Accordingly, in the present embodiment, when the information recorded on the RFID tag includes the food type, operation S5 is performed. Of course, when the food name is recorded on the RFID tag, the food name is automatically stored by the display controller 110, and operation S1 is revisited.

In the determining in operation S5, if it is determined that a food name entry signal has not been input, operation S1 is revisited, and if it is determined that a food name entry signal has been input, the display 120 displays the enter food name screen 220 in operation S6. That is, in the present embodiment, a food name may be entered when an RFID tag has been read, or a food name may be entered when there is no attached RFID tag.

Next, it is determined in operation S7 whether a food name has been entered through an audio input. If it is determined in operation S7 that an audio input of a food name has not been entered, it is determined in operation S8 whether the select list button 221 has been selected.

If it is determined that the select list button 221 has not been selected, operation S7 is revisited, and if it is determined that the select list button 221 has been selected, the display 120 displays the list stored food screen 210 in operation S9. Then, a user selects the name of the food to be stored in the list stored food screen 210 in operation S10.

If it is determined in operation S7 that a food name has been input through audio or that a food name has been selected in the list stored food screen, the display 120 displays the verify food entry screen 240 in operation S11. Then, a user can view the food name displayed in the verify food entry screen 240 to check if it is accurate.

Next, it is determined in operation S12 whether the set expiration date button 244 displayed in the enter food name screen 220 has been selected.

If it is determined in operation S12 that the set expiration date button 244 has not been selected, it is determined in operation S13 whether the select list button 243 has been selected. Here, if the select list button 243 has been selected, this denotes that the food name must be re-entered, as described above.

When it is determined that the select list button 243 has been selected, operation S9 is revisited. Conversely, if it is determined in operation S12 that the select list button 243 has not been selected, it is determined that the save button 245 has been selected, and the procedure moves to operation S16 where the display 120 displays the stored food notification screen 260.

If it is determined in operation S12 that the set expiration date button 244 has been selected, the display 120 displays the select expiration date screen 250 in operation S14. Then, the user can select the expiration date in operation S15 in the select expiration date screen 250.

When the expiration date is selected, the display 120 displays the stored food notification screen 260 in operation S16. Then, it is determined in operation S17 whether the add entry button 261 for adding a food name has been selected.

If it is determined that the add entry button 261 has been selected, operation S6 is revisited and subsequent operations are performed again. Conversely, if it is determined that the add entry button 261 has not been selected, the display 120 displays the expiration date alert window 270 on the refrigerator main screen 121 in operation S18.

Next, it is determined in operation S19 whether the view button 272 has been selected. If the view button 272 has been selected, the display 120 displays the list stored food screen 210 in operation S20. Conversely, if it is determined that the view button 272 has not been selected, the expiration date alert window 270 is removed, and the refrigerator main screen 121 remains.

Thus, according to the present embodiment, a food name can be entered through a user's selection or through reading of an RFID tag, and a food name can be entered through audio or through screens on a display, so that a user's range of options is broadened, increasing convenience.

Also, because food items whose names have been stored in a refrigerator can be checked later on, management of stored foods is made easier. In addition, because a user can set expiration dates for stored foods, food being stored for prolonged periods and food going bad can be prevented.

Furthermore, because the display device can be separated from the refrigerator, managing of stored foods can be performed with the display device separated.

Figure 15:
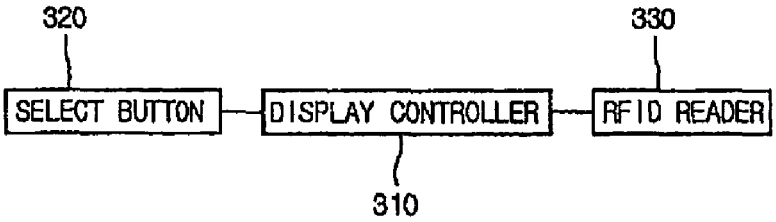
FIG. 15 is a block diagram showing the configuration of a display device according to a second embodiment.

FIG. 15 is a block diagram showing the configuration of a display device according to a second embodiment.

Referring to FIG. 15, a display device 300 according to the present embodiment includes all the elements in the first embodiment, plus an RFID reader 330.

In detail, the display device 300 includes a display controller 310 that controls the operation of the display device 300, the RFID reader 330 that reads data recorded on RFID tags, and a select button 320 for selecting whether to operate the RFID reader 330.

In this case, with the display device 300 separated from the refrigerator, an RFID tag may be read to enter a food name, and in particular, when the display device is carried while shopping for groceries, the information on food that has just been purchased can immediately be stored in the display device 300.

Also, the select button 320 selects ON/OFF functions for the RFID reader 330. When a user carries the display device 300 when shopping, information on foods that the user does not want can be stored in the display device 300.

Therefore, in order to enter information on only foods purchased by the user into the display device 300, the user can press the select button 320 only when needed to activate the RFID reader 330.

INDUSTRIAL APPLICABILITY

In a refrigerator and a method for controlling a refrigerator according to present embodiments, names of foods can be entered through user selections or reading of RFID tags, and names of food items can be input through audio or entered into a display, so that a user's range of options is expanded to increase convenience, for a high industrial applicability.

The invention claimed is:

1. A refrigerator comprising:

a main body;

a display device separable from the main body or a door, and comprising a display;

a radio frequency identification (RFID) reader on the main body;

a main body controller on the main body, the main body controller configured to control the overall operation of the refrigerator;

an audio output outputting through audio to an outside whether to enter a food name, when an RFID tag attached to a food item or a container holding the food item is read by the RFID reader;

an audio input on the display device, to which audio from the outside can be input;

a voice recognizer reading audio input to the audio input; and a display controller controlling the display device to display on the display a screen corresponding to data read by the voice recognizer, wherein the refrigerator allows entering a food name through the audio input or through the screen displayed on the display, through displaying a food name entry screen on the display, when an input is selected for a food name entry output through audio, with the food name entry screen displayed, and wherein the display controller transmits an operation signal inputted by the display device to the main body controller, and the main body controller transmits information on foods read by the RFID reader to the display device.

2. The refrigerator according to claim 1, further comprising an auxiliary display on the main body, the auxiliary display operable when the display device is separated.

3. The refrigerator according to claim 1, wherein the display device further comprises a transceiver that receives digital multimedia broadcasting (DMB) or radio broadcasting signals and outputs the DMB or radio broadcasting signals through the display.

4. The refrigerator according to claim 1, wherein food information is input by audio through the audio input when the display displays a predetermined screen.

5. A refrigerator comprising:

a main body;

a main body controller on the main body, the main body controller configured to control the overall operation of the refrigerator;

a display device separable from the main body or a door, and comprising a display;

an input on the display device to manipulate for entering information on a food item that is stored;

a radio frequency identification (RFID) reader on the display device or the main body, for reading an RFID tag attached to the stored food item or a container holding the stored food item;

an audio input on the display device, to which audio from an outside can be input;

a voice recognizer reading the audio input to the audio input; and a display controller controlling the display device to display on the display a screen corresponding to data read by the voice recognizer, to data read by the RFID reader, or to data input to the input, wherein the display controller transmits an operation signal inputted by the display device to the main body controller, and the main body controller transmits information on foods read by the RFID reader to the display device.

6. The refrigerator according to claim 5, wherein the display device further comprises an audio output outputting audio corresponding to the audio read by the voice recognizer.

7. The refrigerator according to claim 5, wherein entry of a name of stored food is input through the RFID reader, the audio input, or the input.

8. The refrigerator according to claim 5, wherein the display device is provided on a door opening and closing the main body.

9. The refrigerator according to claim 5, further comprising a coupling portion on the door to enable the display device to be detachably mounted.

* * * * *